US010900430B2

(12) United States Patent
Kuzuyama

(10) Patent No.: US 10,900,430 B2
(45) Date of Patent: Jan. 26, 2021

(54) INTERNAL COMBUSTION ENGINE AND CONTROL DEVICE FOR INTERNAL COMBUSTION ENGINE

(71) Applicants: TOYOTA JIDOSHA KABUSHIKI KAISHA, Toyota (JP); KABUSHIKI KAISHA TOYOTA JIDOSHOKKI, Kariya (JP)

(72) Inventor: Hiroshi Kuzuyama, Kariya (JP)

(73) Assignees: TOYOTA JIDOSHA KABUSHIKI KAISHA, Toyota (JP); KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 16/396,003

(22) Filed: Apr. 26, 2019

(65) Prior Publication Data

US 2019/0331041 A1 Oct. 31, 2019

(30) Foreign Application Priority Data

Apr. 27, 2018 (JP) ..... 2018-086727

(51) Int. Cl.
*F02D 41/06* (2006.01)
*F02D 41/40* (2006.01)

(52) U.S. Cl.
CPC ..... *F02D 41/064* (2013.01); *F02D 41/403* (2013.01); *F02D 2200/021* (2013.01)

(58) Field of Classification Search
CPC ..... F02D 41/064; F02D 41/403; F02D 2200/021; F02D 41/402; F02D 41/405; F02D 41/068; F02D 41/3035; F02D 41/38; F02D 41/401
See application file for complete search history.

(56) References Cited

U.S. PATENT DOCUMENTS

2015/0090217 A1 4/2015 Kuzuyama et al.
2016/0341135 A1 11/2016 Shirahashi et al.
2019/0085778 A1* 3/2019 Kurtz ..... F01N 9/002

FOREIGN PATENT DOCUMENTS

JP 2015-068284 A 4/2015
JP 2016-217215 A 12/2016

* cited by examiner

*Primary Examiner* — Xiao En Mo
(74) *Attorney, Agent, or Firm* — Sughrue Mion, PLLC

(57) ABSTRACT

A control device for an internal combustion engine keeping down an increase in combustion noise at the time of a cold state, provided with a combustion control part successively performing at least pre-fuel injection, first main fuel injection, and second main fuel injection to perform premix charged compressive ignition so that heat is generated inside the combustion chamber in stages a plurality of times, the combustion control part comprising a target value setting part setting target injection amounts and target injection timings of the pre-fuel injection, first main fuel injection, and second main fuel injection and a correction part performing correction to make the target injection amount of the pre-fuel injection increase and make the target injection amount of the second main injection decrease when the temperature of the engine body or the temperature of a parameter with a correlative relationship with the temperature of the engine body becomes a predetermined temperature or less.

5 Claims, 10 Drawing Sheets

INTERNAL COMBUSTION ENGINE AND CONTROL DEVICE FOR INTERNAL COMBUSTION ENGINE

CROSS-REFERENCE TO RELATED APPLICATION

This application claims priority based on Japanese Patent Application No. 2018-086727 filed with the Japan Patent Office on Apr. 27, 2018, the entire contents of which are incorporated into the present specification by reference.

FIELD

The present disclosure relates to an internal combustion engine and a control device for an internal combustion engine.

BACKGROUND

Japanese Unexamined Patent Publication No. 2015-068284 discloses, as a conventional control device for an internal combustion engine, a device configured to divide main fuel injection into two to perform premix charged compressive ignition (PCCI) to thereby cause the generation of heat two times in stages so that a pressure waveform showing changes in rate of cylinder pressure rise along with time (cylinder pressure rise pattern) becomes a two-peak shape. According to Japanese Unexamined Patent Publication No. 2015-068284, due to this, it is considered possible to reduce the combustion noise.

SUMMARY

However, the above-mentioned conventional control device for an internal combustion engine did not consider the time of the cold state before completion of engine warm-up. At the time of the cold state, the ignitability of the fuel deteriorates, so compared with the time of the warm state after completion of engine warm-up, the ignition delay time of the fuel easily becomes longer. For this reason, at the time of the cold state, even if dividing the main fuel injection into two, sometimes the fuel injected by the different fuel injections will not burn in stages, but will end up burning at the same timing. As a result, at the time of the cold state, the pressure waveform showing changes in rate of cylinder pressure rise along with time (cylinder pressure rise pattern) will not become a two-peak shape, but will end up becoming a single-peak shape and the combustion noise will increase.

The present disclosure was made taking note of such a problem and has as its object to keep the combustion noise from increasing at the time of a cold state.

To solve this problem, according to one aspect of the present disclosure, there is provided a control device for an internal combustion engine for controlling an internal combustion engine provided with an engine body and a fuel injector injecting fuel into a combustion chamber of the engine body. The control device is provided with a combustion control part successively performing at least pre-fuel injection, first main fuel injection, and second main fuel injection to perform premix charged compressive ignition so that heat is generated inside the combustion chamber in stages a plurality of times. The combustion control part is configured provided with a target value setting part setting target injection amounts and target injection timings of pre-fuel injection, first main fuel injection, and second main fuel injection and a correction part performing correction to make the target injection amount of the pre-fuel injection increase and make the target injection amount of the second main fuel injection decrease when a temperature of the engine body or a temperature of a parameter with a correlative relationship with the temperature of the engine body becomes a predetermined temperature or less.

To solve this problem, according to another aspect of the present disclosure, there is provided an internal combustion engine comprising an engine body, a fuel injector injecting fuel into a combustion chamber of the engine body and a control device configured to perform at least pre-fuel injection, first main fuel injection, and second main fuel injection to perform premix charged compressive ignition so that heat is generated inside the combustion chamber in stages a plurality of times. The control device is further configured to set target injection amounts and target injection timings of pre-fuel injection, first main fuel injection, and second main fuel injection and to perform correction to make the target injection amount of the pre-fuel injection increase and make the target injection amount of the second main fuel injection decrease when a temperature of the engine body or a temperature of a parameter with a correlative relationship with the temperature of the engine body becomes a predetermined temperature or less.

According to these aspect of the present disclosure, it is possible to keep the combustion noise from increasing at the time of a cold state.

DESCRIPTION OF EMBODIMENTS

Figure 1:
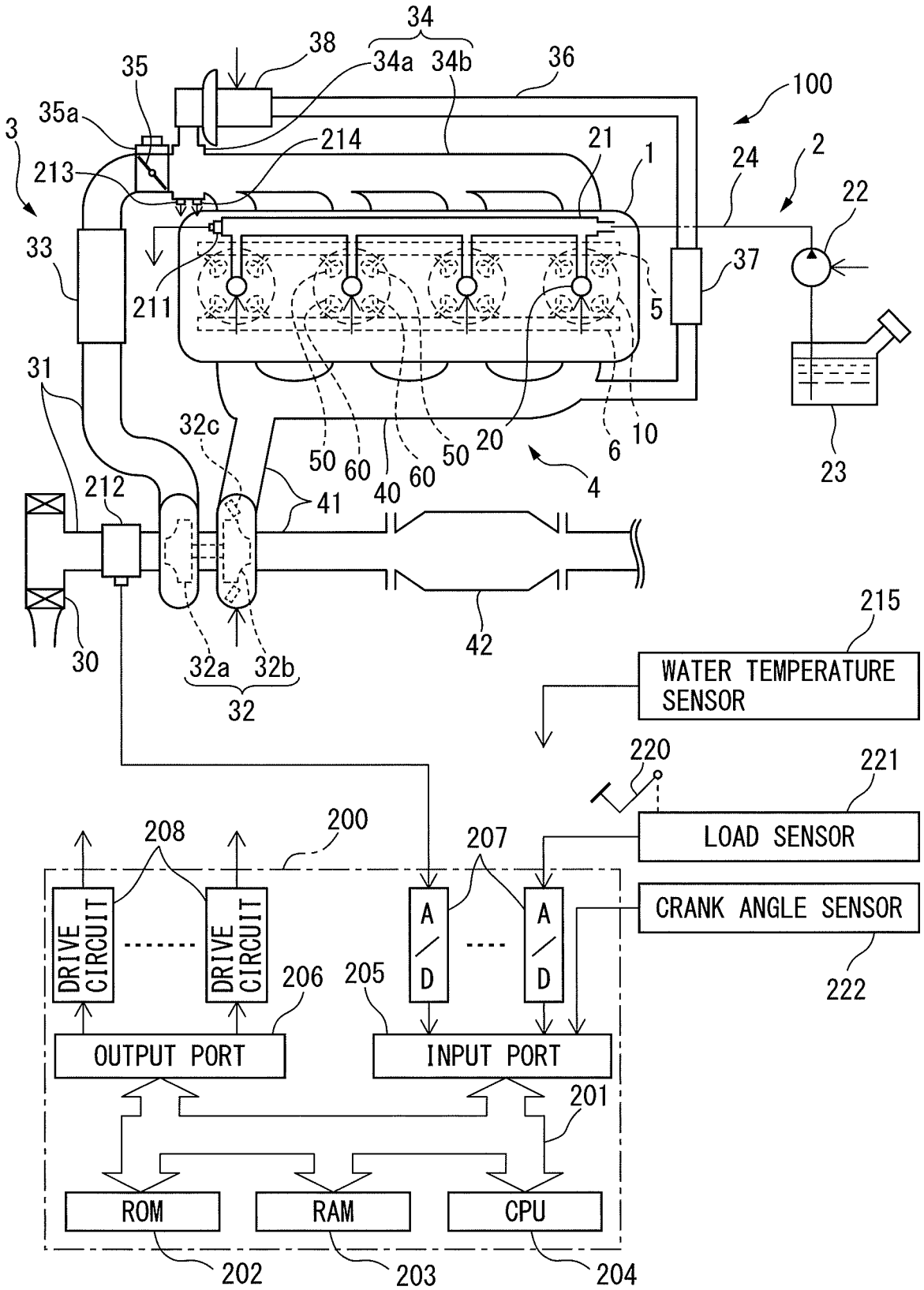
FIG. 1 is a schematic view of the configuration of an internal combustion engine and an electronic control unit controlling the internal combustion engine according to a first embodiment of the present disclosure.

Below, referring to the drawings, embodiments of the present disclosure will be explained in detail. Note that, in the following explanation, similar component elements will be assigned the same reference numerals.

First Embodiment

Figure 2:
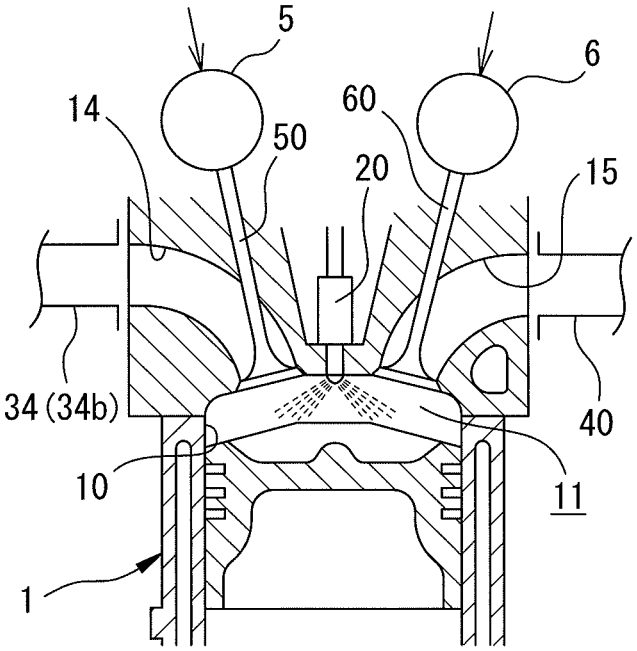
FIG. 2 is a cross-sectional view of an engine body of the internal combustion engine.

FIG. 1 is a schematic view of the configuration of an internal combustion engine 100 and an electronic control unit 200 controlling the internal combustion engine 100 according to a first embodiment of the present disclosure. FIG. 2 is a cross-sectional view of an engine body 1 of the internal combustion engine 100.

As shown in FIG. 1, the internal combustion engine 100 is provided with an engine body 1 provided with a plurality of cylinders 10, a fuel supply system 2, an intake system 3, an exhaust system 4, an intake valve operating system 5, and an exhaust valve operating system 6.

The engine body 1 makes fuel burn in combustion chambers 11 formed in the cylinders 10 (see FIG. 2) to for example generate power for driving a vehicle etc. The engine body 1 is provided with a pair of intake valves 50 and a pair of exhaust valves 60 for each cylinder.

The fuel supply system 2 is provided with electronic control type fuel injectors 20, a delivery pipe 21, supply pump 22, fuel tank 23, pumping pipe 24, and fuel pressure sensor 211.

One fuel injector 20 is provided at each cylinder 10 so as to face a combustion chamber 11 of the cylinder 10 so as to enable fuel to be directly injected into the combustion chamber 11. The opening time (injection amount) and opening timing (injection timing) of the fuel injector 20 are changed by control signals from the electronic control unit 200. If a fuel injector 20 is operated, fuel is directly injected from the fuel injector 20 to the inside of the combustion chamber 11.

The delivery pipe 21 is connected through the pumping pipe 24 to the fuel tank 23. In the middle of the pumping pipe 24, a supply pump 22 is provided for pressurizing the fuel stored in the fuel tank 23 and supplying it to the delivery pipe 21. The delivery pipe 21 temporarily stores the high pressure fuel pumped from the supply pump 22. If a fuel injector 20 is operated, the high pressure fuel stored in the delivery pipe 21 is directly injected from the fuel injector 20 to the inside of a combustion chamber 11.

The supply pump 22 is configured to be able to change the discharge amount. The discharge amount of the supply pump 22 is changed by a control signal from the electronic control unit 200. By controlling the discharge amount of the supply pump 22, the fuel pressure inside the delivery pipe 21, that is, the injection pressure of the fuel injector 20, is controlled.

A fuel pressure sensor 211 is provided in the delivery pipe 21. The fuel pressure sensor 211 detects the fuel pressure inside the delivery pipe 21, that is, the pressure of the fuel injected from the fuel injectors 20 to the insides of the cylinders 10 (injection pressure).

The intake system 3 is a system for guiding air to the insides of the combustion chambers 11 and is configured to enable change of the state of air taken into the combustion chambers 11 (intake pressure (supercharging pressure), intake temperature, and amount of EGR (exhaust gas recirculation) gas). That is, the intake system 3 is configured to be able to change the oxygen density inside the combustion chambers 11. The intake system 3 is provided with an air cleaner 30, intake pipe 31, compressor 32*a* of a turbocharger 32, intercooler 33, intake manifold 34, electronic control type throttle valve 35, air flow meter 212, EGR passage 36, EGR cooler 37, and EGR valve 38.

The air cleaner 30 removes sand and other foreign matter contained in the air.

The intake pipe 31 is coupled at one end to an air cleaner 30 and is coupled at the other end to a surge tank 34*a* of the intake manifold 34.

The turbocharger 32 is a type of supercharger. It uses the energy of the exhaust to forcibly compress the air and supplies the compressed air to the combustion chambers 11. Due to this, the charging efficiency is enhanced, so the engine output increases. The compressor 32*a* is a part forming a portion of the turbocharger 32 and is provided at the intake pipe 31. The compressor 32*a* is turned by a turbine 32*b* of the later explained turbocharger 32 provided coaxially with it and forcibly compresses the air. Note that instead of the turbocharger 32, it is also possible to use a supercharger mechanically driven utilizing the rotational force of a crankshaft (not shown).

The intercooler 33 is provided downstream from the compressor 32*a* in the intake pipe 31 and cools the air which was compressed by a compressor 32*a* and thereby became high in temperature.

The intake manifold 34 is provided with the surge tank 34*a* and a plurality of intake runners 34*b* branched from the surge tank 34*a* and connected with openings of intake ports 14 (see FIG. 2) formed inside of the engine body 1. The air guided to the surge tank 34*a* is evenly distributed through the intake runners 34*b* and intake ports 14 to the insides of the combustion chambers 11. In this way, the intake pipe 31, intake manifold 34, and intake ports 14 form an intake passage for guiding air to the insides of the combustion chambers 11. At the surge tank 34*a*, a pressure sensor 213 for detecting the pressure inside the surge tank 34*a* (intake pressure) and a temperature sensor 214 for detecting the temperature inside the surge tank 34*a* (intake temperature) are attached.

The throttle valve 35 is provided inside the intake pipe 31 between the intercooler 33 and the surge tank 34*a*. The throttle valve 35 is driven by a throttle actuator 35*a* and makes the passage cross-sectional area of the intake pipe 31 change continuously or in stages. By using the throttle actuator 35*a* to adjust the opening degree of the throttle valve 35, it is possible to adjust the amount of flow of air taken into the combustion chambers 11.

The air flow meter 212 is provided at the upstream side from the compressor 32*a* inside the intake pipe 31. The air flow meter 212 detects the amount of flow of air flowing through the intake passage and finally taken into the combustion chambers 11 (below, referred to as the "intake air amount").

The EGR passage 36 is a passage which connects the later explained exhaust manifold 40 and the surge tank 34*a* of the intake manifold 34 and returns part of the exhaust discharged from the combustion chambers 11 to the surge tank 34*a* using the pressure difference. Below, the exhaust introduced into the EGR passage 36 will be called the "EGR gas" and the ratio of the amount of EGR gas in the amount of gas in the cylinders, that is, the rate of recirculation of the exhaust, will be called the "EGR rate". By making the EGR gas be recirculated to the surge tank 34*a* and in turn the combustion chambers 11, it is possible to reduce the combustion temperature and keep down the discharge of nitrogen oxides ($NO_X$).

The EGR cooler 37 is provided at the EGR passage 36. The EGR cooler 37 is a heat exchanger for cooling the EGR gas by, for example, running wind, cooling water, etc.

The EGR valve 38 is provided at the downstream side in the flow direction of the EGR gas from the EGR cooler 37 in the EGR passage 36. The EGR valve 38 is a solenoid valve able to be adjusted in opening degree continuously or in stages. The opening degree is controlled by the electronic control unit 200. By controlling the opening degree of the EGR valve 38, the flow rate of the EGR gas recirculated to the surge tank 34*a* is adjusted. That is, by controlling the opening degree of the EGR valve 38 to a suitable opening degree in accordance with the intake air amount or intake pressure (supercharging pressure) etc., it is possible to control the EGR rate to any value.

The exhaust system 4 is a system for purifying the exhaust generated inside the combustion chambers and discharging it to the outside air and is provided with the exhaust manifold 40, exhaust pipe 41, turbine 32*b* of the turbocharger 32, and exhaust after-treatment device 42.

The exhaust manifold 40 is provided with a plurality of exhaust runners which are connected to openings of exhaust ports 15 (see FIG. 2) formed inside the engine body 1 and a header which collects the exhaust runners and merges them into one.

The exhaust pipe 41 is connected at one end to a header of the exhaust manifold 40 and is open at the other end. The exhaust discharged from the combustion chambers 11 through the exhaust ports to the exhaust manifold 40 flows through the exhaust pipe 41 and is discharged to the outside air.

The turbine 32*b* is a part forming a portion of the turbocharger 32 and is provided at the exhaust pipe 41. The turbine 32*b* is turned by energy of the exhaust and drives the coaxially provided compressor 32*a*.

At the outside of the turbine 32*b*, a variable nozzle 32*c* is provided. The variable nozzle 32*c* functions as a throttle valve. The nozzle opening degree of the variable nozzle 32*c* (valve opening degree) is controlled by the electronic control unit 200. By changing the nozzle opening degree of the variable nozzle 32*c*, it is possible to change the flow rate of the exhaust driving the turbine 32*b*. That is, by changing the nozzle opening degree of the variable nozzle 32*c*, it is possible to change the rotational speed of the turbine 32*b* and change the supercharging pressure. Specifically, if making the nozzle opening degree of the variable nozzle 32*c* smaller (throttling the variable nozzle 32*c*), the flow rate of the exhaust will rise and the rotational speed of the turbine 32*b* will increase resulting in an increase of the supercharging pressure.

The exhaust after-treatment device 42 is provided at the downstream side from the turbine 32*b* in the exhaust pipe 41. The exhaust after-treatment device 42 is a device for purifying the exhaust and then discharging it to the outside air and contains various types of catalysts for removing harmful substances (for example, a three-way catalyst) carried on a support.

The intake valve operating system 5 is a system for driving operation of the intake valves 50 of the cylinders 10 and is provided at the engine body 1. The intake valve operating system 5 according to the present embodiment is configured to enable control of the operating timings of the intake valves 50, for example, to drive operation of the intake valves 50 by electromagnetic actuators.

The exhaust valve operating system 6 is a system for driving operation of the exhaust valves 60 of the cylinders 10 and is provided at the engine body 1. The exhaust valve operating system 6 according to the present embodiment is configured to enable control of the operating timings of the exhaust valves 60, for example, to drive operation of the exhaust valves 60 by electromagnetic actuators.

Note that, the intake valve operating system 5 and exhaust valve operating system 6 are not limited to electromagnetic actuators. For example, it is also possible to use a camshaft to drive the operation of the intake valves 50 or exhaust valves 60 and provide at one end of the camshaft a variable valve operation mechanism changing the relative phase angle of the camshaft to the crankshaft by hydraulic control to thereby enable control of the operating timings of the intake valves 50 or exhaust valves 60.

The electronic control unit 200 is comprised of a digital computer having components connected with each other by a bidirectional bus 201 such as a ROM (read only memory) 202, RAM (random access memory) 203, CPU (microprocessor) 204, input port 205, and output port 206.

At the input port 205, output signals of the above-mentioned fuel pressure sensor 211 etc. plus an output signal of a water temperature sensor 215 for detecting a temperature of cooling water which cools the engine body 1 are input through corresponding AD converters 207. Further, at the input port 205, the output voltage of a load sensor 221 generating an output voltage proportional to the amount of depression of an accelerator pedal 220 (below, referred to as the "amount of accelerator depression" is input as a signal for detection of the engine load through a corresponding AD converter 207. Further, at the input port 205, as signals for calculating the engine rotational speed etc., the output signal of the crank angle sensor 222 generating an output pulse every time the crankshaft of the engine body 1 rotates by for example 15° is input. In this way, at the input port 205, output signals of various sensors required for control of the internal combustion engine 100 are input.

The output port 206 is connected through corresponding drive circuits 208 to the fuel injectors 20 and other controlled parts.

The electronic control unit 200 outputs control signals for controlling the different controlled parts from the output port 206 based on the output signals of various sensors input to the input port 205 so as to control the internal combustion engine 100. Below, the control of the internal combustion engine 100 which the electronic control unit 200 performs will be explained.

The electronic control unit 200 performs divided injection performing fuel injection a plurality of times with intervals between them so as to operate the engine body 1.

Figure 3:
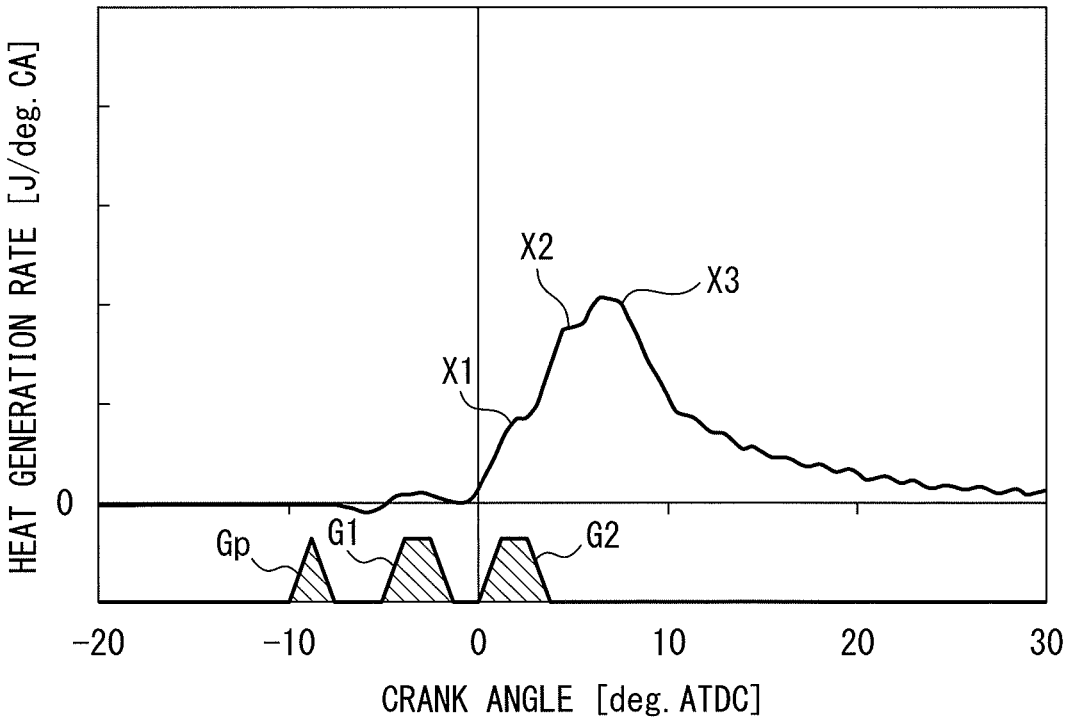
FIG. 3 is a view showing a relationship between a crank angle and heat generation rate according to the first embodiment of the present disclosure.
Figure 4:
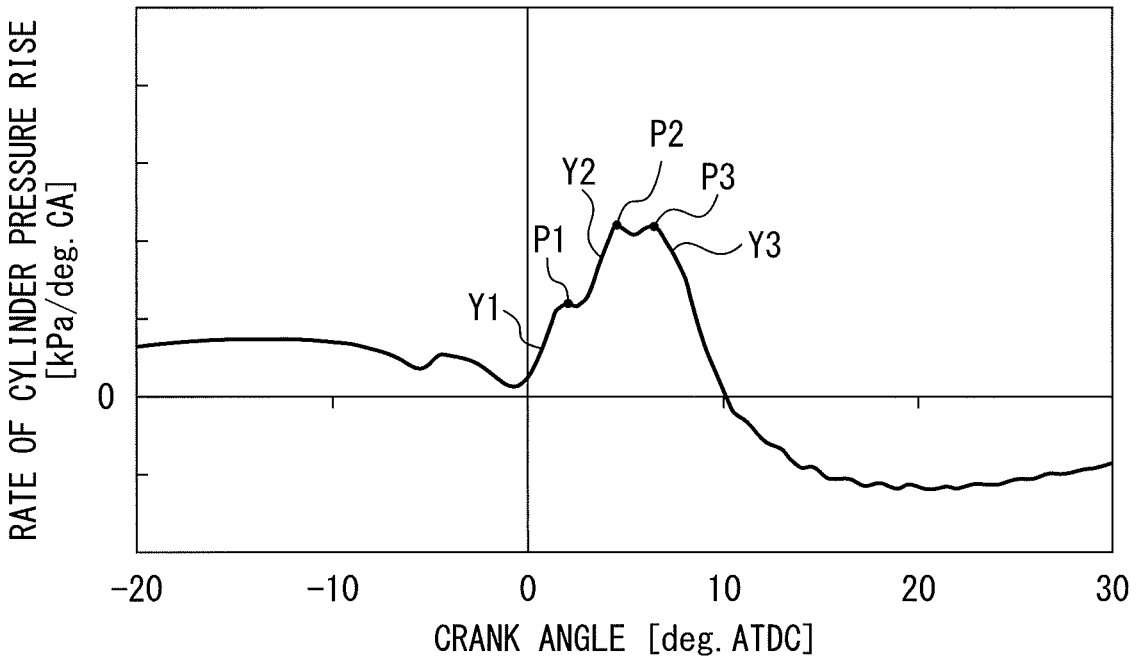
FIG. 4 is a view showing a relationship of a crank angle and rate of cylinder pressure rise according to the first embodiment of the present disclosure.

FIG. 3 is a view showing the relationship between the crank angle and heat generation rate in the case of performing the divided injection according to the present embodiment to make fuel burn at the time of a steady state operation in which the engine operating state (engine rotational speed and engine load) is constant. Further, FIG. 4 is a view showing the relationship between the crank angle and the rate of cylinder pressure rise in this case.

Note that the "heat generation rate ($dQ/d\theta$) [J/deg.CA]" is the amount of heat per unit crank angle generated when making fuel burn, that is, the amount Q of heat generated per unit crank angle. In the following explanation, the combustion waveform showing this relationship between the crank angle and heat generation rate, that is, the combustion waveform showing the change over time of the heat generation rate, will as necessary be called the "heat generation rate pattern". Further, the "rate of cylinder pressure rise ($dP/d\theta$) [kPa/deg.CA]" is the crank angle differential of the cylinder pressure P [kPa]. In the following explanation, the pressure waveform showing this relationship between the crank angle and the rate of cylinder pressure rise, that is, the pressure waveform showing the change over time of the rate of cylinder pressure rise, will as necessary be called the "cylinder pressure rise pattern".

As shown in FIG. 3, the electronic control unit 200 successively performs the pre-fuel injection Gp, first main fuel injection G1, and second main fuel injection G2 to operate the engine body 1. Note that the "pre-fuel injection Gp" basically is injection in which pre-fuel is made to self ignite at the advanced side from the first main fuel and thereby the cylinder temperature made to rise to cause self ignition of the first main fuel. On the other hand, the first main fuel injection G1 and second main fuel injection G2 basically are injections performed for outputting a demanded torque corresponding to the engine load.

At this time, in the present embodiment, the injection amounts and injection timings of the fuel injections Gp, G1, and G2 are controlled to cause generation of heat in stages a plurality of times so that the pre-fuel, first main fuel, and second main fuel basically are burned after a certain extent of premix time with the air after fuel injection for "premix charged compressive ignition".

Specifically, in the present embodiment, as shown in FIG. 3, the injection amounts and injection timings of the fuel injections Gp, G1, and G2 are controlled so that the heat generation rate pattern becomes a three-peak shape so that the first peak of the combustion waveform X1 of the heat generation rate pattern is formed by generation of heat when the pre-fuel is burned, next the second peak of the combustion waveform X2 of the heat generation rate pattern is formed by generation of heat when the first main fuel is burned, and finally the third peak of the combustion waveform X3 of the heat generation rate pattern is formed by generation of heat when the second main fuel is burned.

Further, due to this, as shown in FIG. 4, it is made so that a first peak of a pressure waveform Y1 of the cylinder pressure rise pattern is formed by generation of heat when the pre-fuel is burned, next a second peak of a pressure waveform Y2 of the cylinder pressure rise pattern is formed by generation of heat when the first main fuel is burned, and finally a third peak of a pressure waveform Y3 of the cylinder pressure rise pattern is formed by generation of heat when the second main fuel is burned, whereby the cylinder pressure rise pattern also becomes a three-peak shape along with the heat generation rate pattern.

Figure 5:
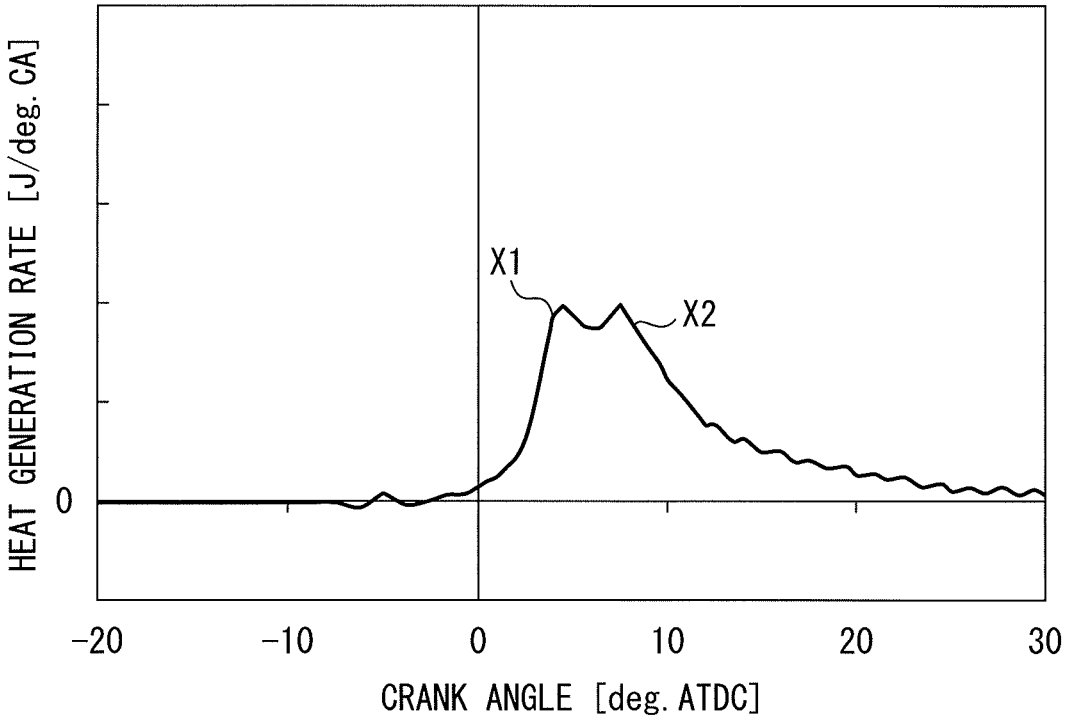
FIG. 5 is a view showing a relationship of a crank angle and heat generation rate according to a modification of the first embodiment of the present disclosure.

Note that, like in the modification of the present embodiment shown in FIG. 5, it is also possible to control the injection amounts and injection timings of the fuel injections Gp, G1, and G2 so that a first peak of a combustion waveform X1 of the heat generation rate pattern is formed by generation of heat when the pre-fuel and the first main fuel are burned, then a second peak of a combustion waveform X2 of the heat generation rate pattern is formed by generation of heat when the second main fuel is burned, whereby the heat generation rate pattern becomes a two-peak shape.

Figure 6:
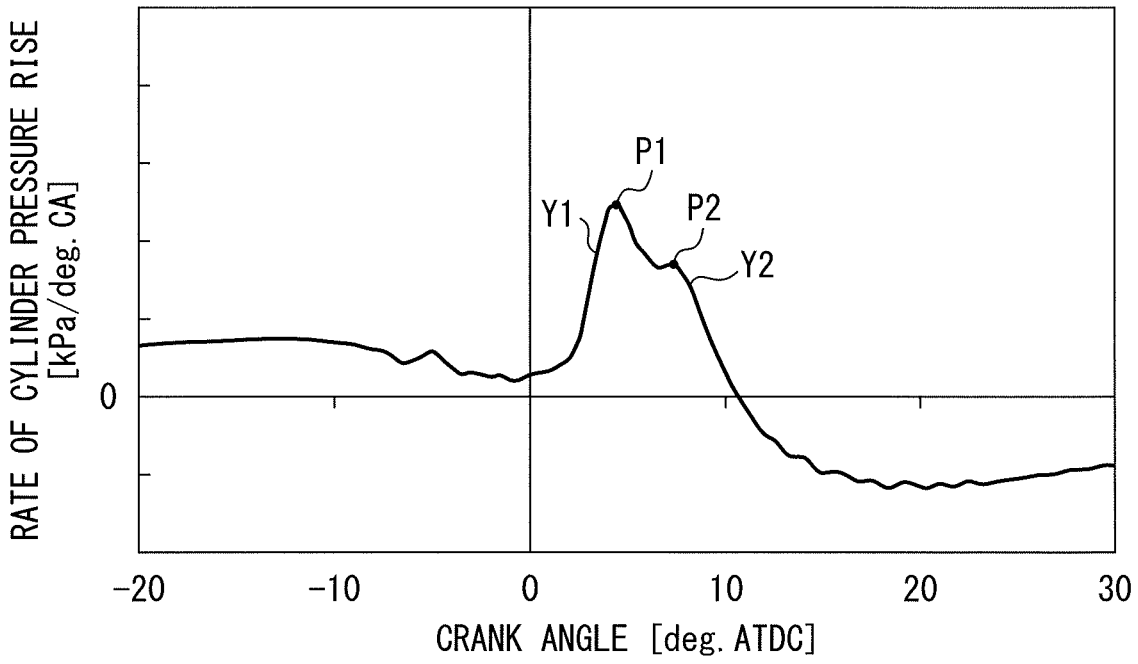
FIG. 6 is a view showing a relationship of a crank angle and rate of cylinder pressure rise according to a modification of the first embodiment of the present disclosure.

Further, due to this, as shown in FIG. 6, it is also possible to make a first peak of a pressure waveform Y1 of the cylinder pressure rise pattern be formed by generation of heat when the pre-fuel and the first main fuel are burned, then make a second peak of a pressure waveform Y2 of the cylinder pressure rise pattern be formed by generation of heat when the second main fuel is burned, whereby the cylinder pressure rise pattern also becomes a two-peak shape along with the heat generation rate pattern.

By causing the generation of heat separated by suitable intervals in stages a plurality of times, it is possible to offset the phases of the two pressure waves generated by adjoining generations of heat among the pressure waves generated by generations of heat (in the example shown in FIG. 4, the pressure waves generated when burning the pre-fuel and the first main fuel and the pressure waves generated when burning the first main fuel and the second main fuel. In the example shown in FIG. 6, the pressure waves generated when burning the first main fuel and the second main fuel) at a specific frequency band.

For this reason, for example, by making one phase the opposite phase with respect to another phase of the pressure wave and otherwise suitably offsetting the phases of the two pressure waves, it is possible to reduce the amplitude of the actual pressure wave at the specific frequency band where these two pressure waves are superposed. Due to this, it is possible to reduce the combustion noise [dB] at a specific frequency band and as a result possible to reduce the overall combustion noise.

Note that, the frequency band at which combustion noise can be reduced changes depending on the interval between the two pressure waves. Basically, it is possible to reduce a higher frequency side combustion noise the narrower the interval between the two pressure waves. The "interval between the two pressure waves" means, for example, if referring to FIG. 4, the interval between the peak value P1 of the pressure waveform Y1 and the peak value P2 of the pressure waveform Y2 and the interval between the peak value P2 of the pressure waveform Y2 and the peak value P3 of the pressure waveform Y3.

Therefore, by, like in the present embodiment, performing the fuel injections Gp, G1, and G2 so that the cylinder pressure rise pattern becomes a three-peak shape to make the interval from the peak value P1 to the peak value P2 and the interval between the peak value P2 and the peak value P3 different, it is possible to reduce the combustion noise [dB] at the two frequency bands at the low frequency side and the high frequency side. For this reason, by performing the fuel injections Gp, G1, and G2 so that the cylinder pressure rise pattern becomes a three-peak shape, it is possible to reduce the overall combustion noise compared with the case of performing the fuel injections Gp, G1, and G2 so that the cylinder pressure rise pattern becomes a two-peak shape.

In this regard, in the present embodiment, heat is generated at suitable intervals in stages a plurality of times in this way to thereby reduce the combustion noise, but at the time of a cold state before the end of warm-up, the cylinder temperature tends to become lower at the time of start of compression compared with the time of a warm state after end of warm-up. For this reason, at the time of a cold state, the ignitability of the fuel deteriorates and the ignition delay time of the fuel easily becomes longer. In particular, when performing divided injection like in the present embodiment, the ignition delay time of the fuel injected by the pre-fuel injection Gp performed first (pre-fuel) easily becomes longer.

Figure 7:
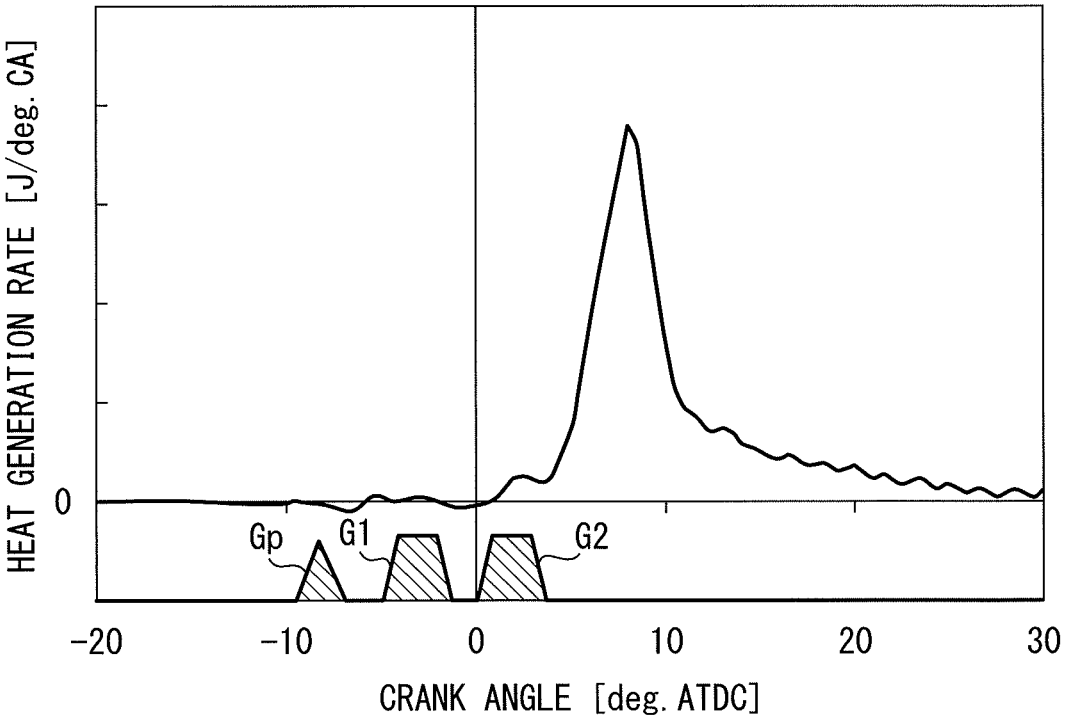
FIG. 7 is a view showing a relationship of a crank angle and heat generation rate at the time of a cold state in a comparative example different from the present disclosure.

As a result, at the time of a cold state, the ignition timing of the pre-fuel and in turn the first main fuel is liable to end up being delayed and, as shown in FIG. 7, the fuel injected by the fuel injections Gp, G1, and G2 are liable to not burn in stages, but burn at the same timing and therefore the heat generation rate pattern is liable to end up becoming a single-peak shape. This being so, the cylinder pressure rise pattern also ends up becoming a single-peak shape, so it ends up becoming impossible to reduce the combustion noise.

Therefore, in the present embodiment, at the time of a cold state, the target injection amount Q1$p$ of the pre-fuel injection Gp is made to increase compared with the time of a warm state. By this, it is possible to keep the ignitability of the pre-fuel from deteriorating and make heat be generated at suitable intervals in stages a plurality of times.

Further, in the present embodiment, when making the target injection amount Qp of the pre-fuel injection Gp increase, that amount of increase is basically subtracted from the target injection amount Q2 of the second main fuel injection G2. This is due to the following reason.

That is, in the present embodiment, the fuel injections Gp, G1, and G2 are successively performed so that the pre-fuel, the first main fuel, and the second main fuel are burned by premix charged compressive ignition, so the fuel injected by the last performed second main fuel injection G2 (second main fuel) tends to become shorter in premixing time with the air until ignition compared with the pre-fuel and the first main fuel. If the premixing time is short, an air-fuel mixture with a higher concentration of fuel is burned compared with if the premixing time is long. For this reason, due to the insufficient oxygen, soot causing smoke becomes easily formed.

Further, when making the target injection amount Qp of the pre-fuel injection Gp increase, by subtracting that amount of increase from the target injection amount Q2 of the second main fuel injection G2, it is possible to reduce the ratio of combustion of premixed fuel with its short premixing time. For this reason, it is possible to keep soot causing smoke from being generated. Below, referring to FIG. 8, the combustion control according to the present embodiment will be explained.

Figure 8:
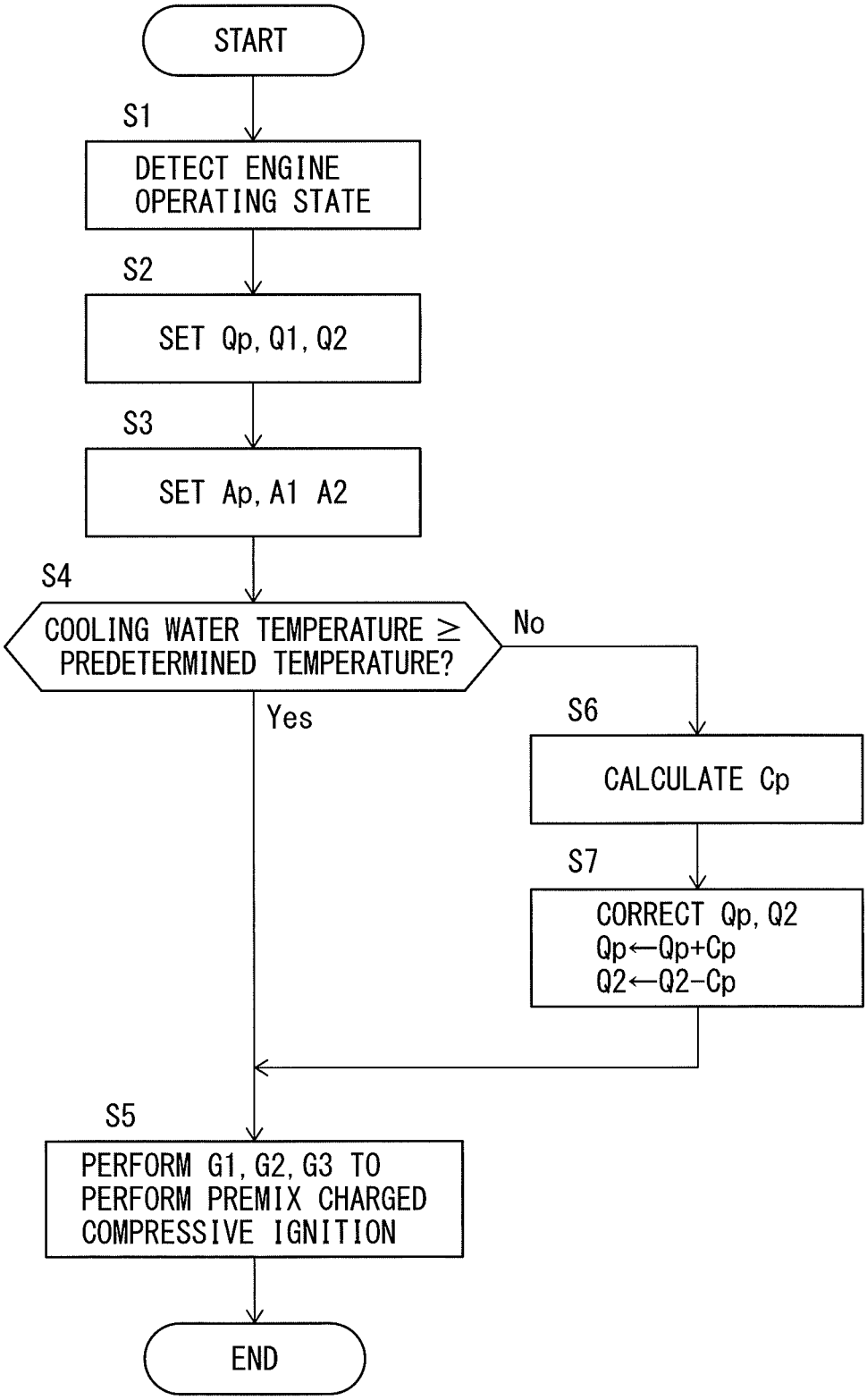
FIG. 8 is a flow chart for explaining combustion control according to the first embodiment of the present disclosure.

FIG. 8 is a flow chart for explaining combustion control according to the present embodiment.

At step S1, the electronic control unit 200 reads the engine rotational speed calculated based on the output signal of the crank angle sensor 222 and the engine load detected by the load sensor 221 and detects the engine operating state.

At step S2, the electronic control unit 200 respectively sets the target injection amount Qp of the pre-fuel injection Gp, the target injection amount Q1 of the first main fuel injection G1, and the target injection amount Q2 of the second main fuel injection G2. In the present embodiment, the electronic control unit 200 refers to tables prepared in advance by experiments etc. and sets the target injection amount Qp, target injection amount Q1, and target injection amount Q2 based on the engine load.

At step S3, the electronic control unit 200 respectively sets the target injection timing Ap of the pre-fuel injection Gp, the target injection timing A1 of the first main fuel injection G1, and the target injection timing A2 of the second main fuel injection G2. In the present embodiment, the electronic control unit 200 refers to tables prepared in advance by experiments etc. and sets the target injection timing Ap, target injection timing A1, and target injection timing A2 based on the engine operating state.

At step S4, the electronic control unit 200 judges if it is the time of a cold state based on the temperature of the engine body 1 or the temperature of a parameter in a correlative relationship with the temperature of the engine body 1. As a parameter in a correlative relationship with the temperature of the engine body 1, for example, the temperature of cooling water for cooling the engine body 1, the temperature of lubricating oil for lubricating sliding parts of the engine body 1, etc. may be mentioned. In the present embodiment, the electronic control unit 200 judges that it is the time of a warm state if the temperature of cooling water detected by the water temperature sensor 215 is a predetermined temperature or more and then proceeds to the processing of step S5. On the other hand, the electronic control unit 200 judges that it is the time of a cold state if the temperature of the cooling water is less than the predetermined temperature and then proceeds to the processing of step S6.

At step S5, the electronic control unit 200 performs the fuel injections Gp, G1, and G2 so that the injection amounts and injection timings of the fuel injections Gp, G1, and G2 become the respectively set target injection amounts Qp, Q1, and Q2 and target injection timings Ap, A1, and A2.

Figure 9:
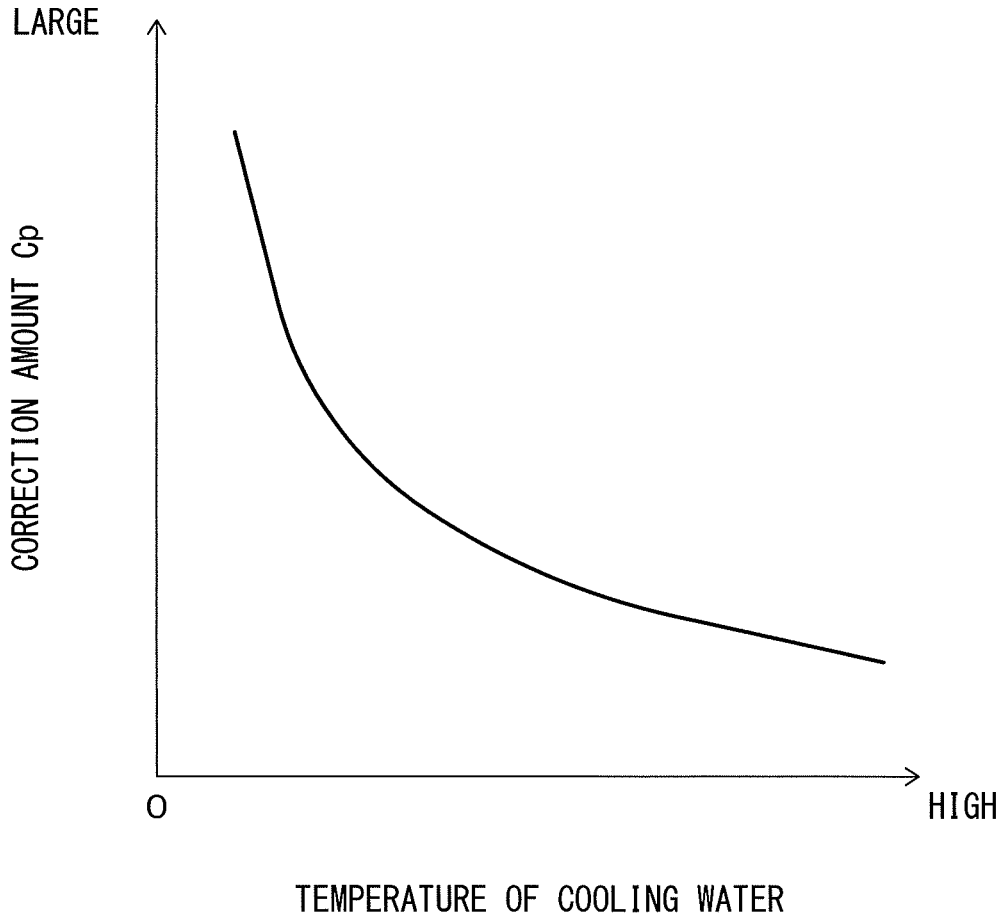
FIG. 9 is a view showing a table for calculating a correction amount Cp based on a temperature of cooling water.

At step S6, the electronic control unit 200 calculates the correction amount Cp for the target injection amount Qp of the pre-fuel injection Gp. In the present embodiment, the electronic control unit 200 refers to the table shown in FIG. 9 prepared in advance by experiments etc. and calculates the correction amount Cp based on the temperature of the cooling water. As shown in FIG. 9, the correction amount Cp basically becomes larger when the temperature of the cooling water is low compared to when it is high.

At step S7, the electronic control unit 200 corrects the target injection amount Qp of the pre-fuel injection Gp and the target injection amount Q2 of the second main fuel injection G2. Specifically, the electronic control unit 200 adds the correction amount Cp to the target injection amount Qp and subtracts the correction amount Cp from the target injection amount Q2.

According to the present embodiment explained above, there is provided an electronic control unit 200 (control device) controlling an internal combustion engine 100. The internal combustion engine 100 comprises an engine body 1 and fuel injectors 20 injecting fuel into combustion chambers 11 of the engine body 1. The control unit 200 comprises a combustion control part successively performing at least pre-fuel injection Gp, first main fuel injection G1, and second main fuel injection G2 to perform premix charged compressive ignition so that heat is generated inside the combustion chambers 11 in stages a plurality of times.

Further, the combustion control part is configured provided with a target value setting part setting target injection amounts Qp, Q1, and Q2 and target injection timings Ap, A1, and A2 of pre-fuel injection Gp, first main fuel injection G1, and second main fuel injection G2 and a correction part performing correction to make the target injection amount Qp of the pre-fuel injection Gp increase and make the target injection amount of the second main injection G2 decrease when the temperature of the engine body 1 or the temperature of a parameter with a correlative relationship with the temperature of the engine body 1 becomes a predetermined temperature or less. Specifically, the correction part is configured to perform correction making the target injection amount Q2 of the second main fuel injection G2 decrease by exactly the amount of increase when performing correction making the target injection amount Qp of the pre-fuel injection Gp increase.

Due to this, at the time of a cold state when the temperature of the engine body 1 or the temperature of a parameter in a correlative relationship with the temperature of the engine body 1 is a predetermined temperature or less, the target injection amount Qp of the pre-fuel injection Gp is made to increase, so it is possible to keep the ignitabilities of the injected fuels from deteriorating.

For this reason, at the time of a cold state, it is possible to keep the ignition timing of the pre-fuel and in turn the first main fuel from ending up being delayed and amounts of fuel injected by the fuel injections Gp, G1, and G2 from not burning in stages, but ending up burning at the same timing. That is, at the time of a cold state as well, it is possible to make the amounts of fuel injected by the fuel injections Gp, G1, and G2 burn in stages and generate heat a plurality of times and possible to offset the phases of the pressure waves generated due to the generations of heat. For this reason, it is possible to keep the combustion noise from increasing at the time of a cold state.

Further, when making the target injection amount Qp of the pre-fuel injection Gp increase, by making the target injection amount Q2 of the second main fuel injection G2, which tends to become shorter in premixing time, decrease, it is possible to keep down the amount of generation of soot causing smoke.

Further, the target value setting part is configured to set the target injection amounts Qp, Q1, and Q2 and target injection timings Ap, A1, and A2 of the pre-fuel injection Gp, first main fuel injection G1, and second main fuel injection G2 so as to make heat be generated in the combustion chambers 11 in stages three times and make the pressure waveform showing the change over time of the rate of cylinder pressure rise (cylinder pressure rise pattern) become a three-peak shape and so that the interval between the peak values P1, P2 of the first peak and the second peak of the pressure waveform and the interval between the peak values P2, P3 of the second peak and the third peak become different. In the present embodiment, the interval between the peak values P1, P2 of the first peak and the second peak of the pressure waveform is made broader than the interval between the peak values P2, P3 of the second peak and the third peak.

Due to this, it is possible to reduce the combustion noise in two different frequency bands, so it is possible to reduce the combustion noise more than when making the cylinder pressure rise pattern a two-peak shape and reducing the combustion noise in one frequency band.

Second Embodiment

Next, a second embodiment of the present disclosure will be explained. The present embodiment differs from the first embodiment on the point that when increasing the target injection amount Qp at the time of the cold state, the amount of increase is reduced from the target injection amount Q1 and target injection amount Q2 as required. Below, that point of difference will be focused on in the explanation.

In the above-mentioned first embodiment, when making the target injection amount Qp of the pre-fuel injection Gp increase at the time of the cold state, that amount of increase was reduced in its entirety from the target injection amount Q2 of the second main fuel injection G2.

However, if reducing the target injection amount Q2 of the second main fuel injection G2 too much, the amount of heat generation when the second main fuel burns becomes smaller and clear heat generation due to combustion of the second main fuel is liable to no longer occur.

For this reason, for example, as explained above referring to FIG. 3 and FIG. 4, if making the heat generation rate pattern and cylinder pressure rise pattern three-peak shapes, it is liable to become impossible to form the third peak of the combustion waveform X3 of the heat generation rate pattern by the heat generation when the second main fuel burns and as a result liable to become impossible to form the third peak of the pressure waveform Y3 of the cylinder pressure rise pattern.

Further, as shown in FIG. 5 and FIG. 6, if making the heat generation rate pattern and the cylinder pressure rise pattern two-peak shapes, it is liable to become impossible to form the second peak of the combustion waveform X2 of the heat generation rate pattern by the heat generation when the second main fuel burns and as a result liable to become impossible to form the second peak of the pressure waveform Y2 of the cylinder pressure rise pattern.

Therefore, in the present embodiment, to prevent the target injection amount Q2 from becoming too small, the ratio α of the total amount of the target injection amount Qp and the target injection amount Q1 to the target injection amount Q2 (=(Qp+Q1)/Q2) is made to become a predetermined ratio αthr or less.

That is, when making the target injection amount Qp increase at the time of the cold state, when subtracting the amount of increase in its entirety from the target injection amount Q2, it is made to judge if the ratio α is a predetermined ratio αthr or less.

Further, if the ratio α becomes larger than the predetermined ratio αthr, the target injection amount Q2 is small compared with the total amount of the target injection amount Qp and the target injection amount Q1. When making the target injection amount Qp increase at the time of the cold state, if subtracting that amount of increase in its entirety from the target injection amount Q2, it is judged that clear heat generation due to combustion of the second main fuel is liable to no longer occur, so it was decided to subtract the amount of increase from the target injection amount Q1 and the target injection amount Q2 so that the ratio α becomes the predetermined ratio αthr or less.

On the other hand, if the ratio α is the predetermined ratio αthr or less, when making the target injection amount Qp increase at the time of the cold state, even if subtracting that amount of increase in its entirety from the target injection amount Q2, it is judged that clear heat generation due to combustion of the second main fuel occurs, so it was decided to subtract the amount of increase in its entirety from the target injection amount Q2 in the same way as the first embodiment.

Figure 10:
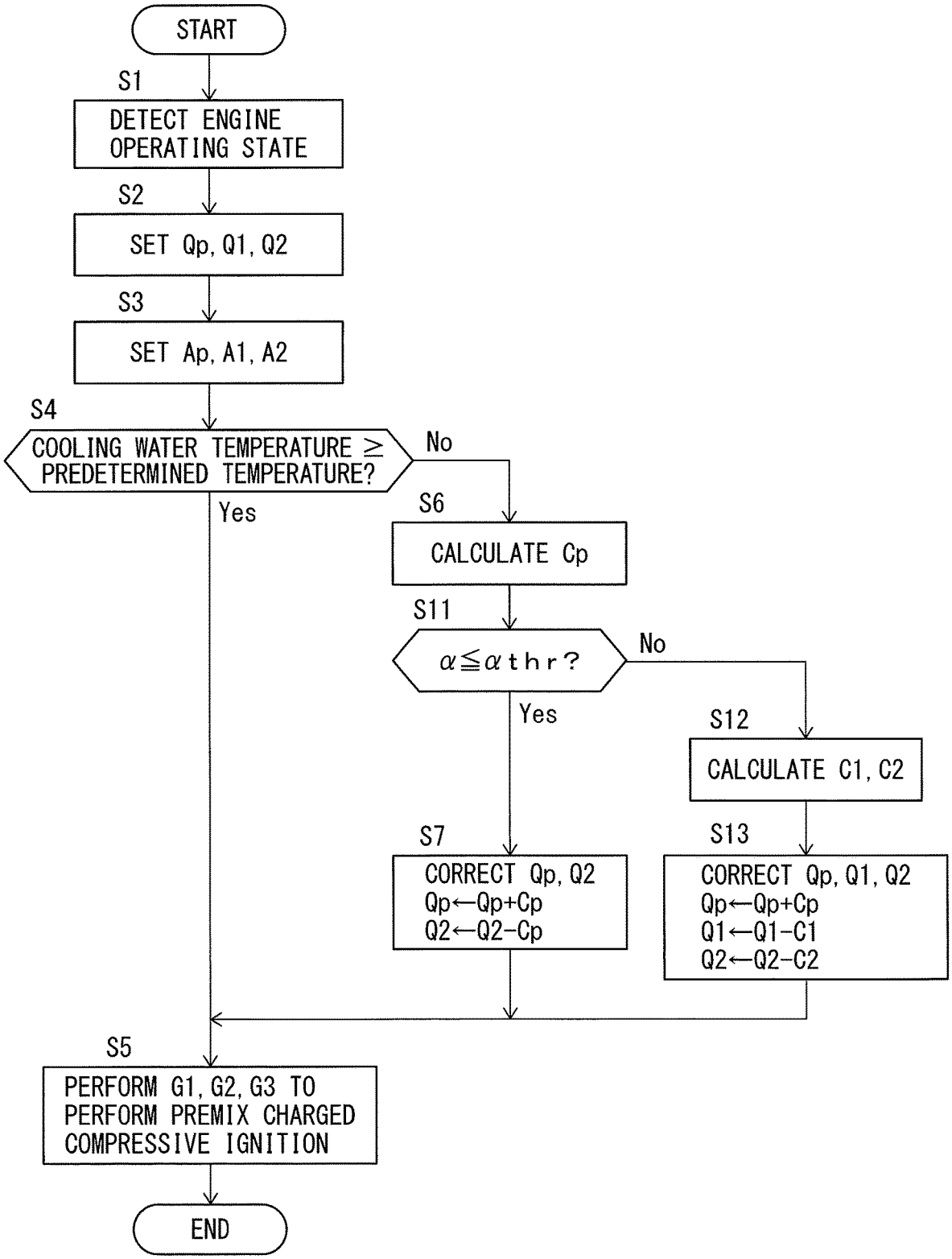
FIG. 10 is a flow chart for explaining combustion control according to a second embodiment of the present disclosure.

FIG. 10 is a flow chart for explaining the combustion control according to the present embodiment. Note that step S1 to step S7 perform processing similar to the first embodiment, so explanations will be omitted here.

At step S11, the electronic control unit 200 judges if the ratio α will become a predetermined ratio αthr or less if adding the correction amount Cp to the target injection amount Qp and subtracting the correction amount Cp from the target injection amount Q2. The electronic control unit 200 proceeds to the processing of step S7 if the ratio α is a predetermined ratio αthr or less. On the other hand, the electronic control unit 200 proceeds to the processing of step S12 if the ratio α is larger than the predetermined ratio αthr.

At step S12, when adding the correction amount Cp to the target injection amount Qp, the electronic control unit 200 subtracts the correction amount Cp corresponding to the amount of increase from the target injection amount Q1 and the target injection amount Q2 so that the ratio α becomes the predetermined ratio αthr. In the present embodiment, the electronic control unit 200 calculates the correction amount C1 and correction amount C2 satisfying the following formula (1) and formula (2) when designating the correction amount for the target injection amount Q1 as C1 and the correction amount for the target injection amount Q2 as C2:

$$Cp=C1+C2 \tag{1}$$

$$\{(Qp+Cp)+(Q1-C1)\}/(Q2-C2)=\alpha\text{thr} \tag{2}$$

At step S13, the electronic control unit 200 corrects the target injection amount Qp of the pre-fuel injection Gp, the target injection amount Q1 of the first main fuel injection G1, and the target injection amount Q2 of the second main fuel injection G2. Specifically, the electronic control unit 200 adds the correction amount Cp to the target injection amount Qp and subtracts the correction amount C1 and correction amount C2 from the target injection amount Q1 and target injection amount Q2.

According to the present embodiment explained above, in the same way as the first embodiment explained above, the combustion control part is provided with a target value setting part and correction part.

Further, the correction part is configured so that when a ratio α of a total amount of the target injection amount Q1 of the pre-fuel injection Gp and the target injection amount Q1 of the first main fuel injection G1 with respect to the target injection amount Q2 of the second main fuel injection G2 becomes larger than a predetermined ratio αthr when performing correction to make the target injection amount Qp of the pre-fuel injection Gp increase and performing correction to subtract that amount of increase from the target injection amount Q2 of the second main fuel injection G2, it performs correction for making the target injection amount Q1 of the first main fuel injection G1 and the target injection amount Q2 of the second main fuel injection G2 decrease by exactly that amount of increase so that the ratio α becomes the predetermined ratio αthr or less.

Due to this, it is possible to keep the amount of heat generation when the second main fuel is burned from becoming too small and clear heat generation due to the combustion of the second main fuel from no longer occurring. For this reason, it is possible to cause heat generation a plurality of times and possible to offset the phases of pressure waves formed due to the heat generations, so it is possible to keep the combustion noise from increasing.

Above, embodiments of the present disclosure were explained, but the embodiments only show part of the examples of application of the present disclosure and are not meant to limit the technical scope of the present disclosure to the specific constitutions of the above embodiments.

The invention claimed is:

1. A control device for an internal combustion engine, the internal combustion comprising:

an engine body; and a fuel injector injecting fuel inside a combustion chamber of the engine body, wherein the control device comprises a combustion control part configured to perform at least pre-fuel injection, first main fuel injection, and second main fuel injection to perform premix charged compressive ignition so that heat is generated inside the combustion chamber in stages a plurality of times, and the combustion control part comprises:

a target value setting part configured to set target injection amounts and target injection timings of the pre-fuel injection, first main fuel injection, and second main fuel injection; and a correction part configured to perform correction to make the target injection amount of the pre-fuel injection increase and make the target injection amount of the second main injection decrease in response to a temperature of the engine body or a temperature of a parameter with a correlative relationship with the temperature of the engine body becoming less than a predetermined temperature.

2. The control device for the internal combustion engine according to claim 1, wherein the correction part is further configured to perform correction making the target injection amount of the second main fuel injection decrease by exactly the amount of increase when performing correction to make the target injection amount of the pre-fuel injection increase.

3. The control device for the internal combustion engine according to claim 1, wherein the correction part is further configured so that when a ratio of a total amount of a target injection amount of the pre-fuel injection and the target injection amount of the first main fuel injection with respect to the target injection amount of the second main fuel injection becomes larger than a predetermined ratio when performing correction to increase the target injection amount of the pre-fuel injection and performing correction to make the target injection amount of the second main fuel injection decrease by exactly that amount of increase, it performs correction for subtracting that amount of increase from the target injection amount of the first main fuel injection and the target injection amount of the second main fuel injection so that the ratio becomes the predetermined ratio or less.

4. The control device for the internal combustion engine according to claim 1, wherein the target value setting part is further configured to set the target injection amounts and target injection timings of the pre-fuel injection, first main fuel injection, and second main fuel injection so as to make heat be generated in the combustion chamber in stages three times whereby a pressure waveform showing changes along with time of the rate of cylinder pressure rise becomes a three-peak shape and so that an interval between the peak values of the first peak and second peak of the pressure waveform and an interval between the peak values of the second peak and the third peak differ.

5. The control device for the internal combustion engine according to claim 4, wherein the interval of the peak values of the first peak and the second peak of the pressure waveform is greater than the interval of the peak values of the second peak and the third peak.

* * * * *